US006694878B2

(12) United States Patent
Pezzetta et al.

(10) Patent No.: US 6,694,878 B2
(45) Date of Patent: Feb. 24, 2004

(54) CYLINDER HAVING CLAMPING SHAFT AND SHAFT ARRESTING DEVICE

(75) Inventors: Gianpaolo Pezzetta, Neustadt an der Weinstrasse (DE); Martin Heinz Schoeps, Güntersleben (DE)

(73) Assignee: Koenig & Bauer Aktiengesellschaft, Wuraburg (DE)

( * ) Notice: Subject to any disclaimer, the term of this patent is extended or adjusted under 35 U.S.C. 154(b) by 0 days.

(21) Appl. No.: 10/275,969

(22) PCT Filed: May 15, 2001

(86) PCT No.: PCT/DE01/01832

§ 371 (c)(1),
(2), (4) Date: Nov. 18, 2002

(87) PCT Pub. No.: WO01/87612

PCT Pub. Date: Nov. 22, 2001

(65) Prior Publication Data

US 2003/0154873 A1 Aug. 21, 2003

(30) Foreign Application Priority Data

May 17, 2000 (DE) ..... 100 24 331

(51) Int. Cl.[7] ..... B41F 27/12
(52) U.S. Cl. ..... 101/415.1; 101/378
(58) Field of Search ..... 101/415.1, 378, 101/409

(56) References Cited

U.S. PATENT DOCUMENTS

| | | | | |
|---|---|---|---|---|
| 3,727,551 A | * | 4/1973 | Kostas et al. | 101/415.1 |
| 4,417,514 A | | 11/1983 | Hoshino | |
| 4,495,865 A | | 1/1985 | Kamoda | |
| 5,062,363 A | | 11/1991 | Reichel | |
| 5,131,327 A | * | 7/1992 | Nagasono et al. | 101/415.1 |
| 5,383,401 A | | 1/1995 | Brotzman | |
| 5,653,170 A | | 8/1997 | Puschnerat et al. | |
| 6,101,942 A | * | 8/2000 | Robert | 101/415.1 |

FOREIGN PATENT DOCUMENTS

| | | |
|---|---|---|
| DE | 29 10 880 | 9/1980 |
| DE | 34 01 760 | 8/1985 |
| DE | 40 05 093 | 6/1991 |
| DE | 44 42 300 A | 8/1995 |
| DE | 195 09 561 A | 9/1996 |

* cited by examiner

*Primary Examiner*—Leslie J. Evanisko
(74) *Attorney, Agent, or Firm*—Jones, Tullar & Cooper PC

(57) ABSTRACT

A device that is useable to clamp a rotatable shaft or spindle and which is provided with cams or pressure pieces, to retain or to tension packings on a cylinder, is provided. The shaft or spindle can be both rotated about an axis of rotation, as well as clamped against rotation by the device. The device can be pivoted with respect to the shaft or spindle about a pivot axis which is essentially perpendicular to the axis of rotation of the shaft or spindle. The pivotable device can be provided as a pawl or lever that interacts with a pair of stops to hold it in a shaft or spindle locking position.

23 Claims, 3 Drawing Sheets

CYLINDER HAVING CLAMPING SHAFT AND SHAFT ARRESTING DEVICE

FIELD OF THE INVENTION

The present invention is directed to a device for clamping and/or tensioning. More specifically, the present invention is specifically directed to a device for clamping or tensioning a plate or a packing on a cylinder.

BACKGROUND OF THE INVENTION

DE 195 09 561 C2 discloses a device for clamping plates, which has a swiveling spindle. The plates are frictionally held between a channel wall and pressure cams that are arranged radially in the spindle. Clamping is performed by turning the swiveling spindle until the cams act almost normally on the plates resting against the channel wall. In a similar manner, DE 40 05 093 C1 shows an eccentrically seated spindle, which frictionally clamps the plates between its surface shell and the channel wall when the spindle is turned.

A device for actuating a tensioning device is known from DE 34 01 760 A1, in which the tensioning spindle is structured as a profiled shaft. Tensioning takes place by turning the head of the tensioning spindle, which projects past the end face of the cylinder, and which displaces a tensioning strip in the circumferential direction. The spindle is non-positively secured against an automatic return movement by pressing the surface of a pin of the spindle into a bracket.

U.S. Pat. No. 4,495,865 shows a device for accomplishing the positive arresting of a device for tensioning packings on cylinders by turning a spindle. A crown gear is assigned to one of the ends of the spindle. Arresting is performed by the use of a blade, which is placed nearly tangentially against the crown gear. The shape of the teeth and the arrangement of the blade have been selected in such a way that turning of the spindle in the tensioning direction is possible, but a return movement is prevented. To release the device, the blade is pivoted away from the crown gear by actuating a lever that is assigned to the blade.

DE 44 42 300 A1 also shows a device for tensioning packings, that has an arresting device which, in the operating state, permits turning of the tensioning device in the tensioning direction, but blocks a return movement. Tensioning and arresting, or releasing, here takes place by the use of a single actuating device that is arranged in an extension of the spindle and which is turned for tensioning the packing in the circumferential direction of the spindle, and for arresting/releasing the spindle is moved axially in respect to the spindle axis. No limitation of the travel or force in the tensioning direction is provided.

DE 29 10 880 C2 also discloses a device for tensioning a packing, wherein the tensioning of a packing and the arresting of a shaft takes place by the use of a single device. Tensioning and arresting by the utilization of the friction of a threaded bolt arranged in a screw thread takes place by the same movement.

A device for clamping/tensioning a packing and for arresting the device is known from U.S. Pat. No. 4,417,517. Tensioning is performed by the use of swiveling a shaft, and arresting is accomplished by the use of a lever which must be specifically actuated.

SUMMARY OF THE INVENTION

The object of the present invention is directed to providing a device for clamping and/or tensioning.

In accordance with the present invention, this object is attained by providing a packing clamping or tensioning device in which packing clamping and tensioning, as well as the arresting of a shaft with respect to its axis of rotation, can be performed by a single device. For clamping and tensioning, this single device can be rotated about an axis that is parallel with the rotational axis of the shaft. For arresting movement of the shaft, the device is pivotable about a pivot axis that is perpendicular to the axis of rotation of the shaft.

An advantage to be achieved by the present invention resides, in particular, in that one single device permits both clamping, or tensioning of packings and, at the same time, the positive arresting in the desired position of the clamping device. An actuation of separately provided devices for arresting, or releasing, and for clamping, or tensioning, is not required. The device for clamping or tensioning, in accordance with the present invention, is simple to operate and can be accurately and dependably arrested in respect to available locking mechanisms.

A further advantage of the device of the present invention is that arresting is provided by the provision of a positive connection, wherein the effective surfaces take place nearly perpendicularly to the circumferential surface and therefore normal in respect to the possible movement or force direction of the shaft or spindle. Release of the subject device, in response to centrifugal forces, or to fluctuations or micro-movements, as is possible with the use of non-positive connections or with the use of resilient lever mechanisms, cannot occur.

Arresting can be performed in a simple self-locking manner. In the operating state of the cylinder, i.e. in the state of rest of the device for clamping and/or tensioning, the device is maintained positively arrested.

The arrangement of the present invention, with the arresting device acting positively in both directions of rotation of the spindle, is particularly advantageous. This permits an exact, reproducible positioning of the shaft or spindle, and thus of the surfaces working together with the packing, and further permits a defined position, independently of pretensioning of the device or the packing. The position of the spindle is important, in particular, for non-positive or for positive holding or tensioning with the aid of profiled shafts, cams or gripping members on shafts. A small positional change of the surface in the circumferential direction, which works together with the packing, or an initially not quite exactly set position might cause the "opening" of the device, in particular, if the operation is performed at dead center (unstable equilibrium). By arresting the spindle in both adjustment directions, the unintentional displacement of the spindle by forces or movements which are oriented out of the channel, as well as forces or movements directed into the channel, is prevented. The former are caused, for example, by the pulling force of the packing or by a centrifugal force. The latter are caused for example, by changes in length or by an evening-out of the packing over the circumference of the cylinder. If there is only a frictional connection between the packing and the surface of the spindle acting together with the packing, the packing can move further into the channel without the spindle being displaced in the circumferential direction and therefore turned out of its desired position.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
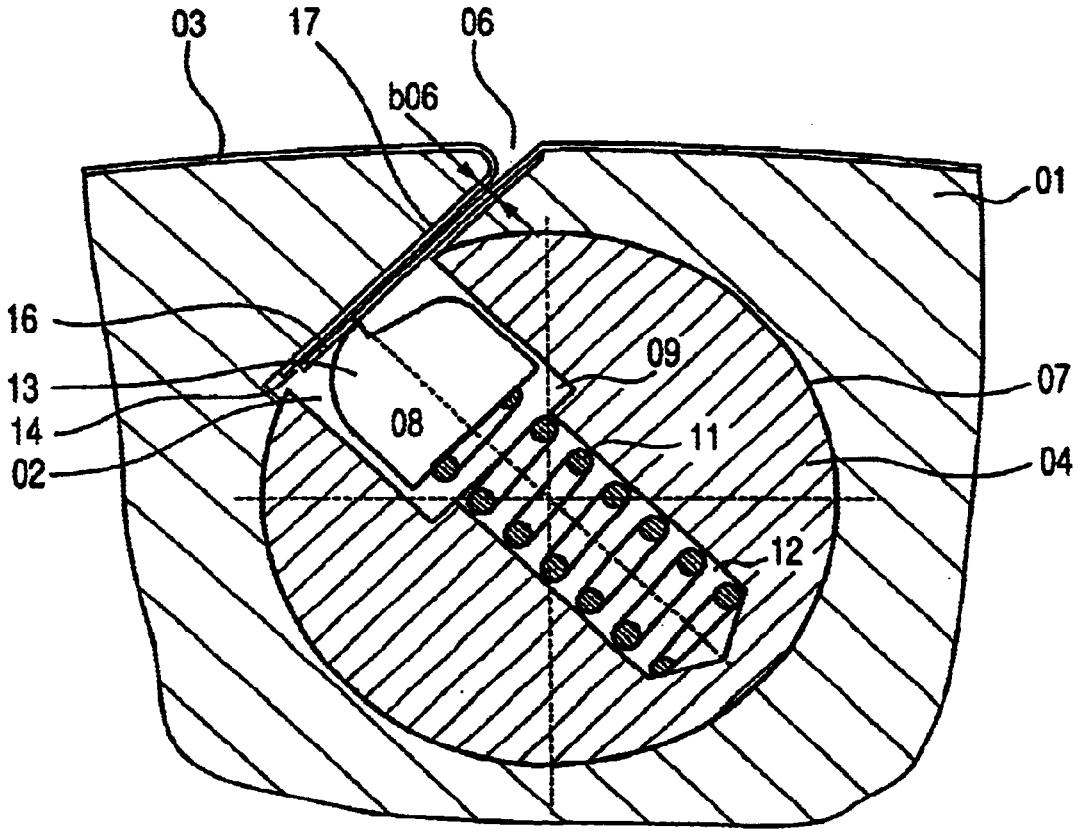
FIG. 1, a cross-sectional view through a channel of a cylinder which is provided with a clamping and/or a tensioning device, FIG. 2, an isometric view of the device for clamping and/or tensioning in accordance with the present invention, FIG. 3, a cross-sectional view through the device for clamping and/or tensioning in an arrested position A, and in FIG. 4, a cross-sectional view through the device for clamping and/or tensioning, in accordance with the present invention, in a released position B.

A device for the non-positive or for the positive holding and/or tensioning of at least one packing 03, for example in the form of a printing plate 03, on a formed cylinder 01, or a rubber blanket 03 on a transfer cylinder 01, is arranged in an axially extending channel 02 of a cylinder 01, for example a formed or a transfer cylinder 01 of a printing press.

The actuation of the device for tensioning or holding the packing 03 is performed through a shaft 04, for example a spindle 04 which is provided with thrust pads, and which shaft or spindle 04 is rotatably seated in the channel 02 of the cylinder 01.

The channel 02, which extends parallel with the cylinder axis of rotation, has a slit 06 on the surface shell of the cylinder 01, and a bore 07 located in the interior of the cylinder 01 and connected with the slit 06. A width b06, for example b06=1 mm, of the slit 06 has slightly more than twice the thickness of the packing 03. The shaft 04, which, in the depicted configuration is a rotatable spindle 04, is arranged in the bore 07.

In order to accomplish the clamping of the packing 03, both ends of the packing 03 are fed into the slit 06 and are clamped by rotating the spindle 04 with the aid of the clamping and/or tensioning device of the present invention. The spindle 04 is provided with thrust pads 08 for use in clamping or tensioning the ends of the packing 03. A hook strip 08, for example, which is arranged in a recess 09, formed, for example as a groove 09, and extending in the axial direction on the circumference of the spindle 04, is used as the thrust pad 08 for the non-positive holding of the packing 03. The hook strip 08 is pressed in a radial direction, with respect to the spindle 04, out of the spindle 04 and against the packing 03 by resilient elements 11, for example by compression springs 11. The compression springs 11 are located in blind bores 12, which are spaced apart from each other in the axial direction of the spindle 04 and are arranged in the bottom surface of the groove 09. The head of the hook strip 06, which cooperates with the packing 03, can be provided with a continuous hook 13, or with several individual hooks 13 that are spaced apart from each other in the longitudinal or axial direction of the spindle 04, this hook 13 or these spaced hooks 13, in the clamping and tensioning device depicted in FIG. 1, act together with the edge 14 of the packing 03, or with corresponding recesses 16 in the packing 03, for releasing the packing 03.

The non-positive connection between a wall 17, that is formed in the cylinder as part of the slit 06, and leading and trailing ends of the packing 03, together with the hook or hooks 13 arranged on the head of the hook strip 08, is greatest when the force exerted by the compressing springs 11, through the hook strip 08, acts perpendicularly on the ends of the packing 03.

The shaft 04 can also be a profiled shaft, such as, for example, an eccentric shaft, a shaft or spindle provided with cams, or an eccentrically seated shaft or spindle. The shaft 04, when it is turned, works either directly with the packing 03 in a frictionally connected or non-positive way by use of its active surface, or it actuates a movable mechanism, which mechanism, in turn cooperates with the packing 03. The surface of the shaft 04, which works either directly with the packing 03 in a frictionally connected or non-positive way with the packing 03, or which works with the intermediate movable device, is identified as the active surface of the shaft or spindle 04.

Figure 2:
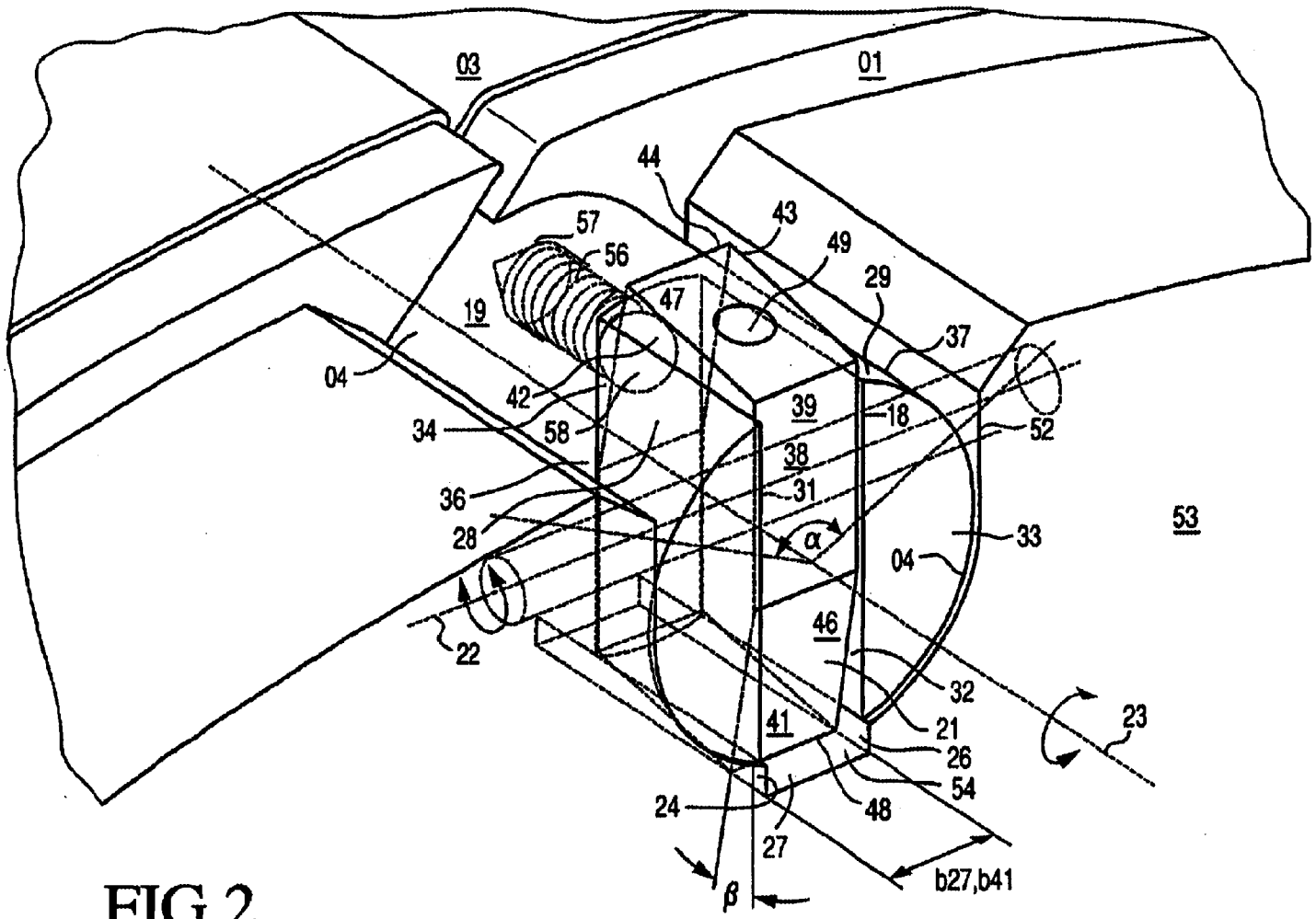
Figure 3:
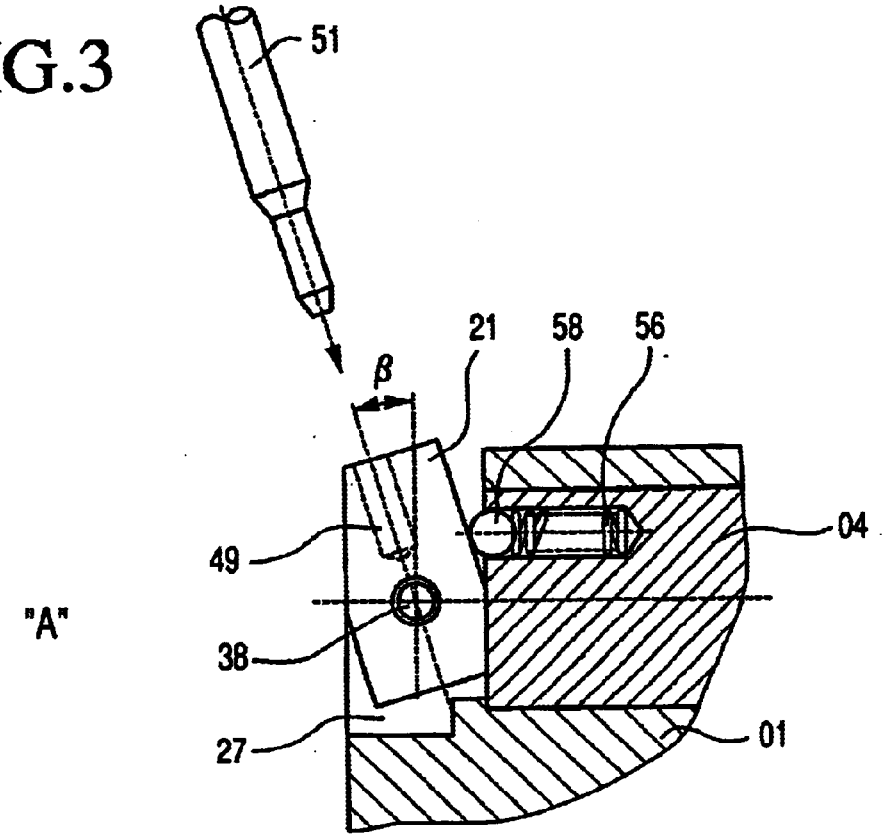
Figure 4:
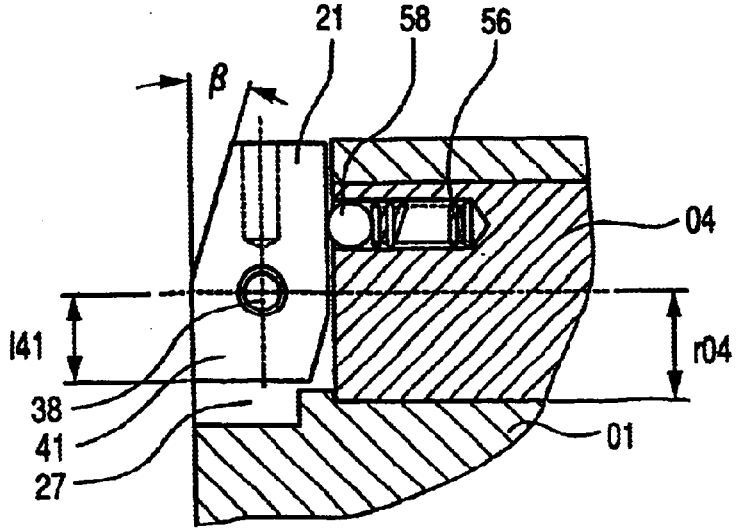

The device for clamping and/or tensioning, in accordance with the present invention, includes a recess 18 in a surface shell 19 of the shaft 04, in which a pivotable lever 21 is arranged, all as seen in FIG. 2. The pivot axis 22 of the lever 21 extends nearly perpendicularly with respect to the rotational axis 23 of the shaft or spindle 04. For tensioning or clamping the packing 03, the shaft 04 is turned around its rotational axis 23, in an advantageous manner, with the aid of the lever 21. For arresting or releasing the shaft 04, the lever 21 is pivoted around its pivot axis 22 as seen in FIGS. 3 and 4. The shape and position of the lever 21 is structured in such a way that in a first position, which is the arrested position A shown in FIG. 3, the lever 21 acts in a positive manner together with surfaces 24 and 26 of a pair of detents, for example the lateral surfaces 24 and 26 of a groove 27 that is fixed in the cylinder. In this arrested position A, the shaft 04 is fixed in both rotational directions in relation to its rotational axis 23. In a second position, which is the released position B shown in FIG. 4, the lever 21 lies free with respect to the cylinder 01 and therefore permits turning of the shaft 04.

In the depicted preferred embodiment, the recess 18 at one end of the shaft 04 is configured as a groove 18, which extends continuously through the end of the shaft 04 perpendicularly in relation to the rotational axis 23 of the shaft 04. The groove 18 can also be arranged on a bearing journal assigned to the shaft 04, or on another extension assigned to the shaft 04. In the preferred embodiment, the groove 18 is located at the end face of one end of the shaft 04 and divides that end face into two shaft legs 28 and 29 with opposite leg surfaces 31 and 32 pointing inwardly toward the rotational axis 23 of the shaft 04. Groove 18 also defines a groove inner wall surface 34 that is located between the two legs 28 and 29 and pointing in the direction of the outer end 33 of the shaft 04. Each of the legs 28 and 29 has an outward oriented surface 36 and 37, which surfaces 36 and 37 are, in the present configuration, a part of the shaft surface shell 19.

A bolt 38, which extends in a direction corresponding to the pivot axis 22 and to which the lever 21 is swivelably attached, is arranged in the groove 18. The bolt 38 extends between the surfaces 31 and 32 of the legs 28 and 29 in the interior of the groove 18 and is preferably perpendicular with respect to the rotational axis 23 of the shaft 04. Bolt 38 allows pivoting of the lever 21 in a plane located parallel with the rotational axis 23 of the shaft 04 and perpendicular in respect to the pivot axis 22 of lever 21. The bolt 38 can be a shaft 38 passing through the lever 21 and can be of one piece construction or can be divided, and arranged extending on both sides of the lever 21. It can be non-positively or positively connected in the legs 28 or 29 or in the lever 21, wherein the rotatable seating, for example embodied as bushings or bearings, is then arranged correspondingly, in a first case, the lever 21 or, in a second case, in the legs 28 and 29.

In the depicted preferred embodiment, the lever 21 is embodied as a two-armed lever 21, with respect to the pivot axis 22. The bolt 38, acting as a fulcrum, defines a lever arm 39 to be actuated and a lever arm 41, which acts as a ratchet 41. The lever 21 has two lateral surfaces 42 and 43, which lie nearly parallel to opposite surfaces 31 and 32 of the legs 28 and 29. Lever 21 also has an inner end surface 44 which is facing the groove inner wall surface 34 and a lever outer end surface 46 located diametrically opposite the lever inner end surface 44. In the preferred embodiment, the lever 21 is approximately cuboid and it has top and bottom ends 47 and 48 on opposite ends.

The lever 21 can also be embodied as a one-armed lever. In this case, the ratchet 41 is for example a protrusion 41, which projects laterally out of the outer surface 46 on the lever arm 39 and which, in the arrested position A, enters into the groove 27 fixed on the cylinder.

The lever top end 47, assigned to the lever arm 39 to be actuated, can have an opening 49, for example a bore 49, into which an actuating device 51, for example an actuating arbor 51, is positively inserted for use in extending the lever arm 39, as seen in FIG. 3. The positive connection can also be configured in the opposite manner by the use of an opening 49 in the actuating arbor 51 and by a correspondingly shaded protrusion on the lever arm 39 portion of lever 21.

The dimensions and the position of the lever arm 41 acting as a ratchet 41 are selected in such a way that in the released position B the lever bottom end face 48 terminates flush with the surface shell 19, for example, or at least does not project past it, but in the arrested position A this bottom end face 48 projects past the surface shell 19 and acts positively together with the lateral surfaces 24 and 26 of the groove 27. In the depicted preferred embodiment, the ratchet 41 is a part of the cuboid two-armed armed lever 21 and has a length l41 and a width b41. The bolt 38, arranged perpendicular in respect to the rotational axis 23 of the shaft 04, passes perpendicularly through the surfaces 42 and 43 of the lever 21. The length l41 of the ratchet 41 has been selected to be approximately equal to the radius r04 of the shaft 04, so that the lever bottom end face 48 extends flush nearly in an imagined extension of the surface shell 19. When swiveling the lever 21 over an angle β into the arrested position A, the edge defined by the surfaces 48 and 46 moves out of the imagined course of the surface shell 19. It is possible, in an advantageous manner, for the surface 46 of the cuboid lever 21 to be beveled by the angle β in the area of the lever arm 39 in such a way that, in the arrested position A, the lever 21 does not project out of the end face of the cylinder 01. In the same way, the surface 44 of the cuboid lever 21 can be beveled by the angle β in the area of the lever arm 41 in such a way that, in the arrested position A, the lever 21 does not project into the shaft 04.

The position and shape of the ratchet 41 are matched to the shape and distance of the surfaces 24 and 26 which are respectively acting together with the ratchet 41 as a detent, as well as to the positioning of the shaft 04 in the cylinder 01.

In the depicted preferred embodiment, the end of the shaft 04, which projects from the channel 02 and which is provided with the groove 18 at its end, is positively seated, rotatable around the rotational axis 23, in a bore 52 of the end wall 53 of the cylinder 01. However, for the purpose of operating the lever 21 that is arranged in the groove 18, the shaft 04 is not completely surrounded by the front wall 53 of the cylinder 01. The opening angle a of a channel in the end wall 53 of the cylinder 01 depends on the required travel arc of the lever 21 for actuating the shaft 04 and, for example, can be 70°.

The groove 27, acting together with the ratchet 41, is arranged in the bore 52 parallel with the rotational axis 23 and has a base 54 and the two previously discussed lateral surfaces 24 and 26, which act together with the surfaces 42 and 43 of the ratchet 41. It is also possible for several grooves 27 to be arranged in the bore 52 in the circumferential direction.

The ratchet 41 can also act together with different surfaces 24 and 26 arranged on the cylinder 01, which in the arrested position A positively absorb the force transmitted via the surfaces 42 and 43 of the lever 21 and which are acting tangentially in relation to the surface shell 19 of the shaft 04. This can be, for example, a segment of a hollow wheel with teeth on the inside, and having respective tooth flanks as the surfaces 24 and 26, and with a ratchet 41 embodied as a trapezoidal or triangular prism, working together with them.

The inclinations of the surfaces 24 and 26 working together with the lever 21 as detents, for example embodied as lateral surfaces 24 and 26 of a groove 27, are arranged, in an advantageous manner, nearly parallel with the surfaces 42 and 43 of the lever 21 when the shaft 04 and the lever 21 are in the arrested position A. In an advantageous manner, the surfaces 42, 43, 24 and 26 approximately extend on a plane parallel with the rotational axis 23, and thus in the pivotal plane of the lever 21. It is possible to achieve a positive connection, fixed against a possible rotation of the shaft 04, together with as even as possible a surface pressure, for example, by the arrangement of the surfaces 42, 43, 24 and 26 in a plane extending nearly parallel with the rotational axis 23 and perpendicularly with respect to the tangent of the surface shell 19 of the shaft 04. In order to avoid play in case of a non-positive connection, it is possible to select the width b41 of the ratchet 41 to be nearly equal to the width b27 of the groove 27, or to be nearly equal to the clear distance between the surfaces 24 and 26 respectively, which are acting as detents.

The shape of the end of the ratchet 41 acting together with the cylinder groove 27 with ratchet lateral faces 42 and 43 approaching each other in a slightly wedge-shaped manner in the direction toward the groove 27, is advantageous. In this arrangement, the width b27 of the groove 27, or the clear distance between the surfaces 24 and 26 has been selected to be greater than the narrow side of the lever 21 facing the groove 27, and less than the wider side of the wedge-shaped end of the ratchet 41. In the arrested position A, the ratchet 41 is located as deeply as possible in the groove 27 and constitutes a positive, play-free connection with respect to the possible swivel direction of the shaft 04.

In a preferred embodiment, the lever 21 is in the arrested position A when it is not in operation and it prevents the unintentional rotation of the shaft 04. For this purpose, an element 56 with a resilient action essentially parallel with the rotational axis 23 is arranged in the groove inner wall surface 34 of the shaft 04 and cooperates directly or indirectly with the lever inner end surface 44 in the area of the lever arm 39. In the depicted configuration, the surface 44 has a blind bore 57, in which a spring 56 and a ball 58 are arranged. The spring 56 is supported on the bottom of the blind bore 57 and presses the ball 58, which is arranged in the mouth of the blind bore 57, against the surface 44 of the lever arm 39.

In all configurations, the recess 18, an adjustable device 21, configured as a lever 21, and the two surfaces 24 and 26, each acting together with the lever 21 as detents, mutually affect each other in their detailed shaping and arrangement. The arrangement of a lever 21, which is pivotable in a plane that extends nearly parallel with the rotational axis 23 of the shaft 04 and that has a ratchet 41 which, by use of its lateral surfaces 42 and 43 cooperates with the surfaces 24 and 26 each acting together with the other as detents, is common to all possible configurations. In the arrested position A of the lever 21, the shaft 04 is fixed in both directions in respect to its rotational axis 23. In a different configuration, the surfaces 24, 26, 42 and 43 can also be embodied as contact lines or as contact points.

It is also possible, for example via a gear of toothed wheels, to arrange the rotational movement for clamping/tensioning not directly around the rotational axis 23 of the shaft 04, but around an axis parallel with this rotational axis.

The mode of functioning of the device in accordance with the present invention, for actuating a clamping and/or tensioning device, is as follows:

For changing the packing 03 on the cylinder 01, the lever 21, which is in the arrested position A shown in FIG. 3, is pivoted into the released position B shown in FIG. 4 by pivoting the lever arm 39 against the force of the resilient element 56. In the process, the ratchet 41 moves out of the groove 27 and is in the released position B. The shaft 04, for example the rotatable spindle 04, can now be rotated, by movement of the lever arm 39, around its rotational axis 23 with or without use of the actuating arbor 51. In the preferred embodiment, the shaft 04 is initially rotated into the direction in which the hooks 13 of the hook strip 08, arranged on the spindle 04, extend below the edge 14, or the recesses 14 of the packing 03. Thereafter, the spindle 04 is rotated in the opposite direction, whereupon the hooks 13 push the packing 03 out of the channel 02.

For clamping, or tensioning a newly installed packing 03, the shaft 04, for example the spindle 04, is initially placed in a position in which the hooks 13 are not in the channel 02 that receives the end of the packing 03. In the depicted configuration, the spindle 04 is arranged in this position in such a way that the hooks 13 point radially out toward the surface of the cylinder 01, and not into the slit 06. Both ends of the packing 03 are introduced through the slit 06 into the channel 02 so that they come to rest between a wall 17 or 53, fixed on the cylinder, of the slit 06 and the spindle 04. Thereafter, the spindle 04 is rotated around its rotational axis 23 by use of the lever arm 39 to the extent that the ratchet 41 reaches the position defined by the groove 27 in the cylinder 01. In this position, the hooks 13 act together with the packing 03, and the force of the compression springs 11 acts nearly normally on the packing 03. With the release of the lever arm 39, the ratchet 41 is swiveled, via the resilient element 56, into the groove 27 and is maintained there in a self-locking manner. The shaft 04 is now fixed in the predetermined position against rotating in either possible direction.

While a preferred embodiment of a device for clamping or tensioning a packing on a cylinder in accordance with the present invention has been set forth fully and completely hereinabove, it will be apparent to one of skill in the art that a number of changes in, for example the overall size of the cylinder, the type of printing press the cylinder is used with, and the like could be made without departing from the true spirit and scope of the present invention which is accordingly to be limited only by the appended claims.

What is claimed is:

1. A cylinder in combination with a device for clamping and tensioning a packing on the cylinder comprising:

a clamping shaft supported in the cylinder and rotatable about a clamping shaft rotation axis; and a clamping shaft arresting device useable to rotate said clamping shaft about said clamping shaft rotation axis and to arrest said clamping shaft against rotation about said clamping shaft rotation axis, said clamping shaft arresting device being rotatable about an arresting device rotation axis which extends in the same direction as said clamping shaft rotation axis to rotate said clamping shaft, and being pivotable about an arresting device pivot axis to arrest said clamping shaft, said pivot axis being perpendicular to said clamping shaft rotation axis.

2. The combination of claim 1 wherein said arresting device rotation axis and said clamping shaft rotation axis are the same.

3. The combination of claim 1 wherein said clamping shaft, in an arrested position, is fixed against movement about said clamping shaft rotation axis.

4. The combination of claim 1 wherein said clamping shaft arresting device is a pivotable lever, said pivotable lever being pivotable in a plane extending parallel with said clamping shaft rotation axis, and further including spaced detent surfaces, said pivotable lever engaging said detent surfaces in a clamping shaft arresting position.

5. The combination of claim 4 further including a recess in said clamping shaft, said pivotable lever being arranged in said clamping shaft recess.

6. The combination of claim 4 further including a ratchet with two spaced ratchet surfaces on said pivotable lever, said two spaced ratchet surfaces extending perpendicular to a surface shell of said clamping shaft, said two spaced ratchet surfaces cooperating with said spaced detent surfaces when said pivotable lever is in said clamping shaft arresting position.

7. The combination of claim 6 wherein said detent surfaces and said ratchet surfaces are generally parallel in said clamping shaft arresting position of said pivotable lever.

8. The combination of claim 5 further including a pivot shaft in said recess, said pivotable lever being supported on said pivot shaft.

9. The combination of claim 5 wherein said recess is a groove on an end face of said clamping shaft.

10. The combination of claim 5 wherein said spaced detent surfaces are surfaces of said recess.

11. The combination of claim 5 wherein said clamping shaft is supported in a bore in the cylinder, said detent surfaces being in said bore and at an end wall of the cylinder.

12. The combination of claim 1 wherein said clamping shaft arresting device is a two armed lever having a first lever arm and a second lever arm.

13. The combination of claim 12 wherein said two armed lever is a cuboid.

14. The combination of claim 12 wherein said second lever arm is a ratchet.

15. The combination of claim 1 wherein said clamping shaft arresting device is self locking in a clamping shaft arrested position.

16. The combination of claim 15 further including a resilient element cooperating with said clamping shaft arresting device in said clamping shaft arresting position.

17. The combination of claim 16 further including a blind bore in the clamping shaft, said resilient element being positioned in said blind bore.

18. The combination of claim 1 wherein said clamping shaft is arranged in a printing press.

19. The combination of claim 1 wherein the packing is a printing plate and the cylinder is a formed cylinder.

20. The combination of claim 1 wherein the packing is a rubber blanket and the cylinder is a transfer cylinder.

21. The combination of claim 1 further including a channel in said clamping shaft, said channel extending parallel to said clamping shaft rotation axis, and a slit extending axially on the cylinder, said slit adapted to receive ends of the packing, and further including a bore in the cylinder, said bore receiving said clamping shaft and being connected to said slit.

22. The combination of claim 21 further including at least one thrust element extending radially in said clamping shaft and being resiliently supported.

23. The combination of claim 22 further including a wall on said slit, said packing ends being engaged by said at least one thrust element and being clamped between said slit wall and said at least one thrust element in a clamping position of said clamping shaft.

* * * * *